US010570539B2

(12) United States Patent
Eddy

(10) Patent No.: US 10,570,539 B2
(45) **Date of Patent: *Feb. 25, 2020**

(54) VIKING KNIT HAND TOOL

(71) Applicant: Stephanie J. Eddy, Boise, ID (US)

(72) Inventor: Stephanie J. Eddy, Boise, ID (US)

( * ) Notice: Subject to any disclaimer, the term of this patent is extended or adjusted under 35 U.S.C. 154(b) by 680 days.

This patent is subject to a terminal disclaimer.

(21) Appl. No.: 15/149,880

(22) Filed: May 9, 2016

(65) Prior Publication Data

US 2017/0022639 A1 Jan. 26, 2017

Related U.S. Application Data

(63) Continuation of application No. 13/375,737, filed as application No. PCT/US2010/036979 on Jun. 1, 2010, now Pat. No. 9,334,589.

(Continued)

(51) Int. Cl.
*B21F 45/00* (2006.01)
*D04B 5/00* (2006.01)

(Continued)

(52) U.S. Cl.
CPC ..... *D04B 5/00* (2013.01); *A44C 27/002* (2013.01); *B21F 27/02* (2013.01); *B21F 45/00* (2013.01);

(Continued)

(58) Field of Classification Search
CPC .. B21F 1/002; B21F 7/00; B21F 15/02; B21F 15/04; B21F 27/02; B21F 27/121;

(Continued)

(56) References Cited

U.S. PATENT DOCUMENTS 222,937 A 12/1879 Newcomb
246,648 A 9/1881 Wilcox (Continued)

FOREIGN PATENT DOCUMENTS

JP 2004019087 A 1/2004

OTHER PUBLICATIONS

Michelle Mach, How to Wire Knit with a Knitting Spool, Nov. 25, 2008, "http://www.beadingdaily.com/blogs/daily/archive/2008/11/25/how-to-wire-k- nit-with-a-knitting-spool.aspx".

(Continued)

*Primary Examiner* — Edward T Tolan
(74) *Attorney, Agent, or Firm* — Pedersen & Company, PLLC; Ken J. Pedersen; Barbara S. Pedersen

(57) ABSTRACT

This invention in one embodiment comprises a cylindrical rod with a rotating, removable loop head inserted into the center of the top end of the rod. The loop head is inserted into a vertical hole drilled into the top end of the rod, wherein the loop head is able to rotate in the hole. The loop head has a plurality of outwardly radially extending circumferential loops that receive wire for bending and weaving into the Viking Knit. Preferably, the rod also has an anchor hole, drilled diagonally through the rod near its top end, for receiving and securing a wire. Preferably, the rod also has a conical wire wrap attachment at the bottom of the rod for making wired end caps to cover or enclose the finished Viking Knit Weave. In another embodiment, this invention comprises a hollow cone with a rotating, removable loop head inserted in either or both ends of the cone.

15 Claims, 16 Drawing Sheets

Related U.S. Application Data

(60) Provisional application No. 61/217,622, filed on Jun. 1, 2009, provisional application No. 61/336,370, filed on Jan. 21, 2010.

(51) Int. Cl.

| | |
|---|---|
| ***D04B 3/00*** | (2006.01) |
| ***A44C 27/00*** | (2006.01) |
| ***B21F 27/02*** | (2006.01) |
| ***D04B 39/00*** | (2006.01) |
| ***D04D 1/00*** | (2006.01) |
| *B21F 15/04* | (2006.01) |

(52) U.S. Cl.
CPC ..... *D04B 3/00* (2013.01); *D04B 39/00* (2013.01); *D04D 1/00* (2013.01); *B21F 15/04* (2013.01)

(58) Field of Classification Search
CPC .. B21F 45/00; D04B 3/00; D04B 5/00; A44C 27/00; A44C 27/002
See application file for complete search history.

(56) References Cited

U.S. PATENT DOCUMENTS

| | | | | | |
|---|---|---|---|---|---|
| 289,578 | A | | 12/1883 | Stewart | |
| 450,671 | A | * | 4/1891 | Hoffmann | B21F 15/04 140/118 |
| 758,829 | A | | 5/1904 | Dood | |
| 1,067,790 | A | * | 7/1913 | Williams | B21F 15/04 140/118 |
| 1,181,297 | A | * | 5/1916 | Fenlason | B21F 15/04 140/118 |
| 1,253,782 | A | | 1/1918 | Bryan | |
| 1,318,465 | A | | 10/1919 | Seifarth | |
| 1,500,383 | A | | 7/1924 | Gourie | |
| 1,881,659 | A | | 10/1932 | Kellems | |
| 1,945,195 | A | | 1/1934 | Kellems | |
| 2,129,393 | A | | 9/1938 | Woolhiser | |
| 2,218,345 | A | | 10/1940 | Spaeth | |
| 2,260,443 | A | * | 10/1941 | Downing, Sr. | D07B 7/02 57/361 |
| 2,385,973 | A | | 10/1945 | Eitel et al. | |
| 2,530,576 | A | | 11/1950 | Gregory | |
| 2,658,364 | A | | 11/1953 | Carlson | |
| 2,687,630 | A | | 8/1954 | Carlson | |
| 2,721,284 | A | | 10/1955 | Elmer | |
| 2,752,952 | A | | 7/1956 | Dauphinais | |
| 3,201,954 | A | | 8/1965 | Greczin | |
| 3,244,202 | A | * | 4/1966 | Huang | H01R 43/033 242/439.1 |
| 3,257,828 | A | | 6/1966 | Greczin | |
| 3,413,822 | A | | 12/1968 | Marley | |
| 3,589,034 | A | | 6/1971 | Beecham | |
| 3,788,367 | A | * | 1/1974 | Ackerman | H01R 43/033 140/124 |
| 4,111,242 | A | * | 9/1978 | Jacobson | H01R 43/033 140/124 |
| 4,131,138 | A | | 12/1978 | Boisvert | |
| 4,163,868 | A | * | 8/1979 | Stotts | H02G 1/1202 174/87 |
| 4,335,665 | A | | 6/1982 | Russell | |
| 4,421,145 | A | * | 12/1983 | Broberg, Jr. | B21F 1/002 140/104 |
| 4,423,757 | A | | 1/1984 | Broberg | |
| D293,621 | S | | 1/1988 | Jackson | |
| 4,927,674 | A | | 5/1990 | Smith | |
| 5,927,059 | A | | 7/1999 | Goertz | |
| 5,966,811 | A | | 10/1999 | Zalusky | |
| 6,082,145 | A | | 7/2000 | Lonati et al. | |
| 6,230,748 | B1 | | 5/2001 | Krawietz et al. | |
| 6,321,519 | B1 | | 11/2001 | Goertz | |
| 6,668,871 | B1 | | 12/2003 | Bundy | |
| 6,792,979 | B2 | | 9/2004 | Konya et al. | |
| 6,905,340 | B2 | | 6/2005 | Stansvik | |
| 7,340,878 | B2 | | 3/2008 | Rozenvasser et al. | |
| 7,392,666 | B2 | | 7/2008 | Namiki | |
| 7,504,060 | B2 | | 3/2009 | Brock et al. | |
| 8,136,337 | B2 | | 3/2012 | Jackson | |
| D676,069 | S | | 2/2013 | Fujiwara | |
| 9,334,589 | B2 | | 5/2016 | Eddy | |
| 2005/0189046 | A1 | | 9/2005 | Lefgren | |
| 2009/0188092 | A1 | | 7/2009 | Teresiak | |
| 2011/0265908 | A1 | | 11/2011 | Clerc et al. | |

OTHER PUBLICATIONS

Viking Knit Kit, http://www.cooltoolchick.com/viking.html, at least as early as May 2009.

Cindy's Wire Weaving Kit, http://cooltoolchick.com/weaver.html, at least as early as May 2009.

PCT International Search Report and the Written Opinion, PCT/US2010/036979, dated Jan. 28, 2011, Applicant: Eddy.

* cited by examiner

VIKING KNIT HAND TOOL

This application is a continuation of Ser. No. 13/375,737, filed Dec. 1, 2011, and issuing on May 10, 2016 as U.S. Pat. No. 9,334,589, which is incorporated herein by this reference, and which is a 371 National Phase Entry Application of PCT/US2010/036979, with international filing date of Jun. 1, 2010, entitled "VIKING KNIT HAND TOOL", which claims priority of U.S. Provisional Patent Application Ser. No. 61/217,622, filed Jun. 1, 2009 and entitled "Viking Knit All-In-One Tool" and which also claims priority of U.S. Provisional Application Ser. No. 61/336,370, filed Jan. 21, 2010 and entitled "Lazee Daizee Viking Knit Matrix Cone Tool". The disclosures of these two provisional patent applications are incorporated herein by reference.

BACKGROUND OF THE INVENTION

Field of the Invention

This invention relates generally to the art and jewelry craft industry, and more particularly to a hand tool for making the Viking Knit weave from wire for use in art and jewelry pieces.

Related Art

Viking Knit is an old, traditional wire weave made by a looping technique of the wire around a cylindrical form such as a wooden dowel. The resulting woven wire tube is then gradually reduced in diameter by sequentially pulling the tube through a series of holes of diminishing diameters. Then the drawn Viking Knit is formed into jewelry and other decorative objects.

Methods for fabrication of traditional Viking Knit are centuries old, and have included the use of a solid, cylindrical form such as bone, wood in various sizes, wooden dowels, pencil shapes or more recently, even Allen wrenches. These items are most often attached to a stationary device such as a vise or clamp for ease of manufacture.

According to the prior art practice, before beginning the Viking Knit weave, a start-up bundle of wire loops must be constructed. This is a hand-formed, single-use group of looped wires than can be made by wrapping wire around a thin, solid form, approximately 1" by ⅛", to form loops that are then twisted or made stationary at one end. When the loose loops are parted they are shaped into a semi-flat flower petal-like form that is then bent over one end of the dowel, pencil or Allen wrench, and held in place by the wire shape itself, adhesive tape, additional wire or other means. The bent over form is then used as a base to begin the wire weaving process for the Viking Knit technique. Because the loose loops are not rigid, it can be difficult to get the Viking Knit weave started.

The prior art start-up bundle does not spin freely about a vertical axis as the Knit forms at the end of the dowel, pencil or Allen wrench. Later, the start-up bundle is used as a means of pulling the finished Viking Knit through a draw plate, a series of progressively smaller sized drilled holes, often made from a piece of wood. The Knit is drawn through increasingly smaller holes in the plate, allowing the Knit to reduce in diameter and increase in length. The start-up bundle is then cut away and discarded. Therefore, a new start-up bundle is created for each project.

New wire is added making a small hook at one end of the new wire or by inserting the new wire randomly into the existing Knit and holding it in place until the attachment is made following several additional stitches. An awl or other sharp, pointed instrument is used sometimes to lift the wire from the dowel, pencil or Allen wrench, whereby new stitching is created underneath. Also, preferably, the tool of the present invention is provided in a kit with a separate pointed instrument, like a thumb tack or push pin.

An example of one prior art device for making the Viking Knit is the kit currently advertised at CoolToolChick.com (http://www.cooltoolchick.com/viking.html).

SUMMARY OF THE INVENTION

This invention in one embodiment comprises a cylindrical rod with a rotatable and removable loop head inserted into the center of the top end of the rod. Preferably, the cylindrical rod is a hexagonal, nylon plastic rod. Alternatively, the rod may be dodecagonal. The loop head is made from, for example, a 6-loop Bali silver bead cap secured to the top of a rivet. Alternatively, the loop head may be molded from plastic with 6 or 12 outwardly, radially extending circumferential loops. The loop head is inserted into a vertical hole drilled into the top end of the rod, wherein the loop head is held by gravity, but able to spin or rotate freely in the hole. The vertical hole has an axis substantially parallel to, or even coincident with, the axis of the rod.

Preferably, the rod also has an anchor hole, drilled diagonally through the rod near its top end, for receiving and securing a wire. Also, preferably, the rod has indicia on its outer surface near its top, for indicating approximately the loop length in the first row of the Viking Knit. Metal wires, varying in size, most generally 32-18 gauge, copper-based, color coated wires and precious metal wires, are woven through the loop head and around the rod to form tubular Viking Knit stitches.

Preferably, the rod also has a conical wire wrap attachment at the bottom of the rod for making wired end caps to cover or enclose the finished Viking Knit weave. The conical wire wrap attachment has a hole drilled transversely through it near its bottom for receiving a wire.

Also, preferably, the tool of the present invention is provided in a kit with a separate draw plate for shaping and sizing the finished Viking Knit. The draw plate may be a sturdy, stiff plastic block with several holes of diminishing diameter drilled through it. The finished Viking Knit is sequentially pulled through several holes of diminishing diameter in order to better align the weave stitches and size the outer diameter of the weave.

In another embodiment, this invention comprises a hollow cone with a free-turning loop head inserted in either or both ends of the cone. Preferably, the hollow cone is hexagonal and/or dodecagonal. Also, preferably, the hollow cone has two rows of about 5/64 inch anchor holes about ½ inch apart, drilled into the cone on two sides thereof.

DESCRIPTION OF THE PREFERRED EMBODIMENTS

Referring to the Figures, there are depicted several, but not all, preferred embodiments of the present invention.

Figure 1:
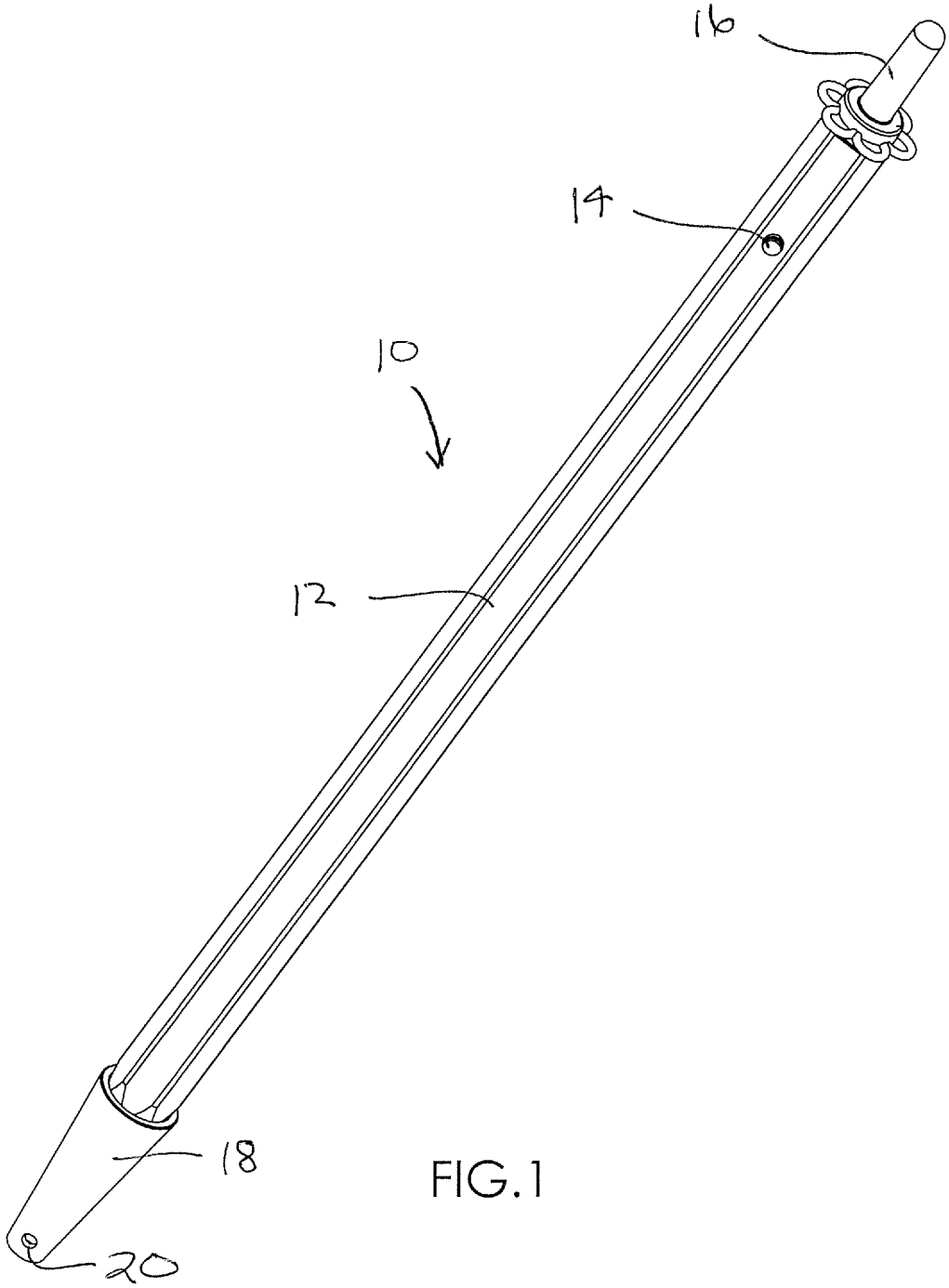
FIG. 1 is a side, perspective view of one embodiment of the present invention in a hexagonal rod.

FIG. 1 depicts a side, perspective view of one embodiment 10 of the present Viking Knit hand tool in a hexagonal rod 12. Rod 12 has an anchor hole 14 drilled into it near its top. Rod 12 has a six (6)-loop head 16 inserted into its top end, and a conical tip 18 secured to its bottom end. Tip 18 has hole 20 drilled through it generally perpendicular to the axis of rod 12.

Figure 2:
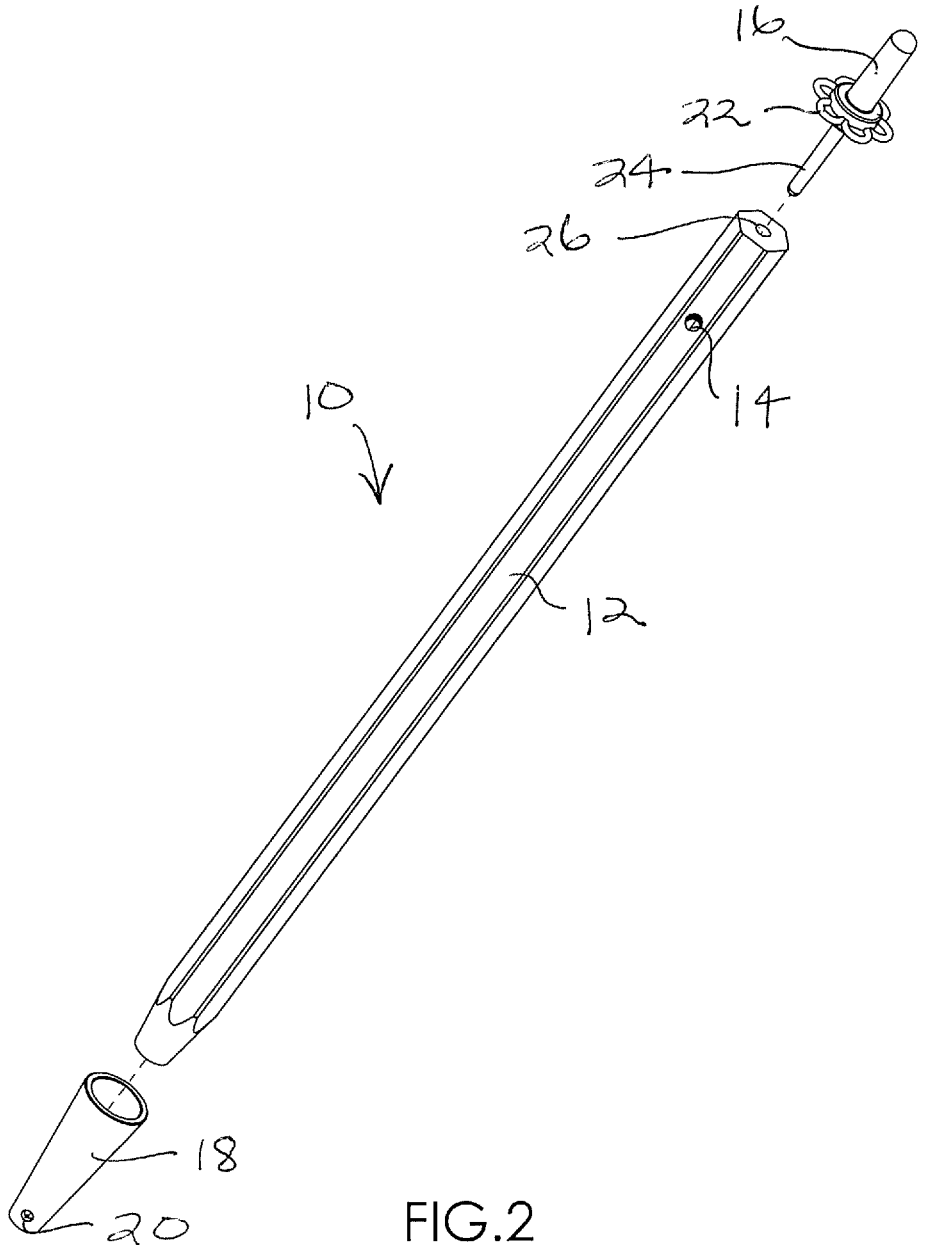
FIG. 2 is an exploded view of the embodiment depicted in FIG. 1.

FIG. 2 depicts an exploded view of the hand tool 10 depicted in FIG. 1. From FIG. 2 it is clear that loop head 16 has six (6) radially extending circumferential loops 22 and a central shaft 24 which fits into central axial hole 26 at the top of rod 12.

Figure 3:
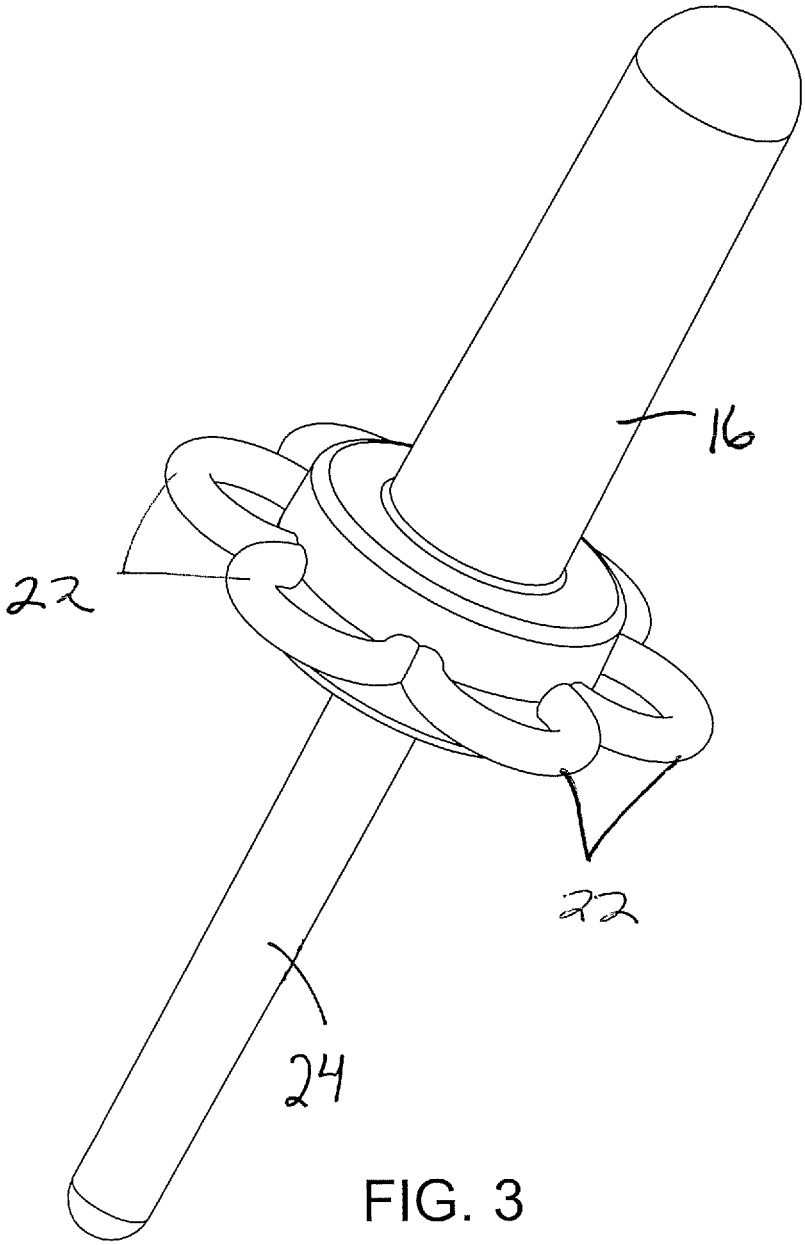
FIG. 3 is a side, perspective, detail view of the six (6)-loop head depicted at the top in FIG. 2.

FIG. 3 depicts a detail view of the six (6)-loop head 16 depicted at the top of FIG. 2.

Figure 4:
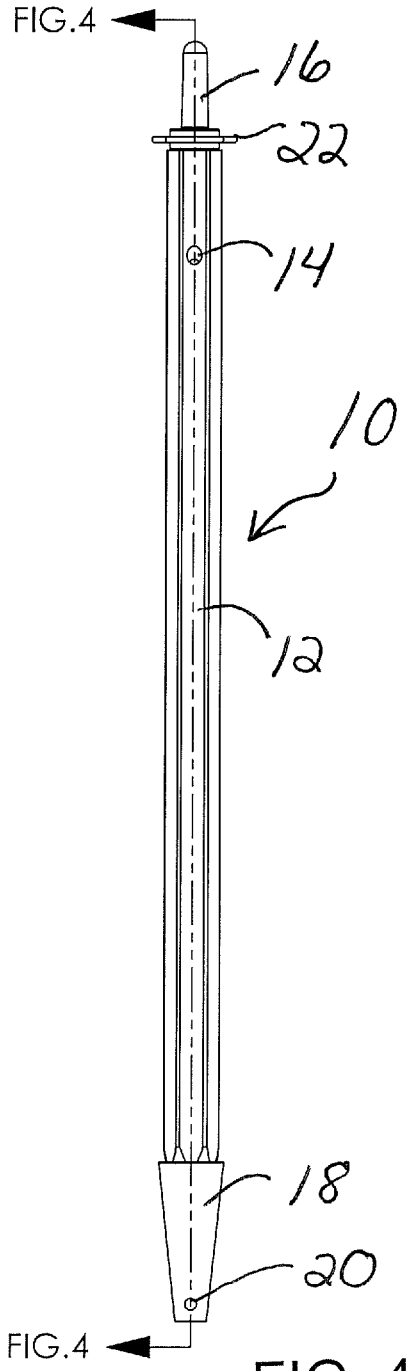
FIG. 4 is a side view of the embodiment depicted in FIG. 1.

FIG. 4 depicts a side view of the hand tool 10 depicted in FIG. 1.

Figure 5:
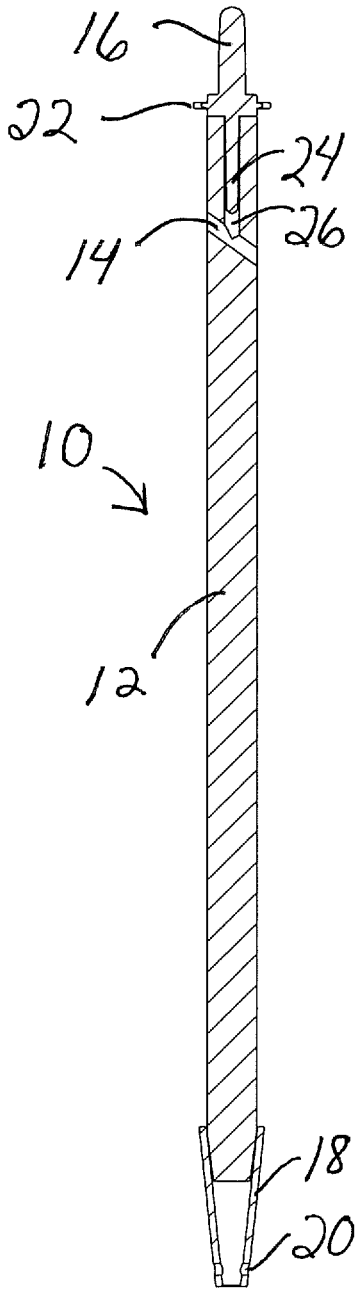
FIG. 5 is a cross-sectional view of the embodiment depicted in FIG. 4, the section being taken along line 5-5 in FIG. 4.

FIG. 5 depicts a cross-sectional view of the hand tool 10 depicted in FIG. 4. From FIG. 5 it is clear that central axial hole 26 extends from the top of rod 12 parallel to the axis of the rod down into anchor hole 14, which anchor hole is drilled diagonally transversely through rod 12.

Figure 6:
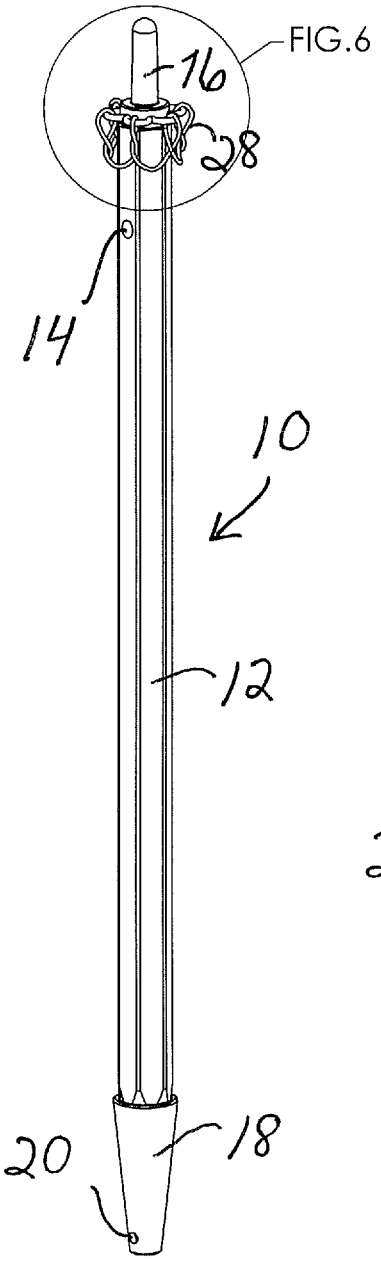
FIG. 6 is a side perspective view of the embodiment depicted in FIG. 1, but with a first row of wire loops hanging from the loop head.

FIG. 6 depicts a side, perspective view of the hand tool 10 depicted in FIG. 1, but with an additional first row of wire loops 28 hanging from the loop head 16.

Figure 7:
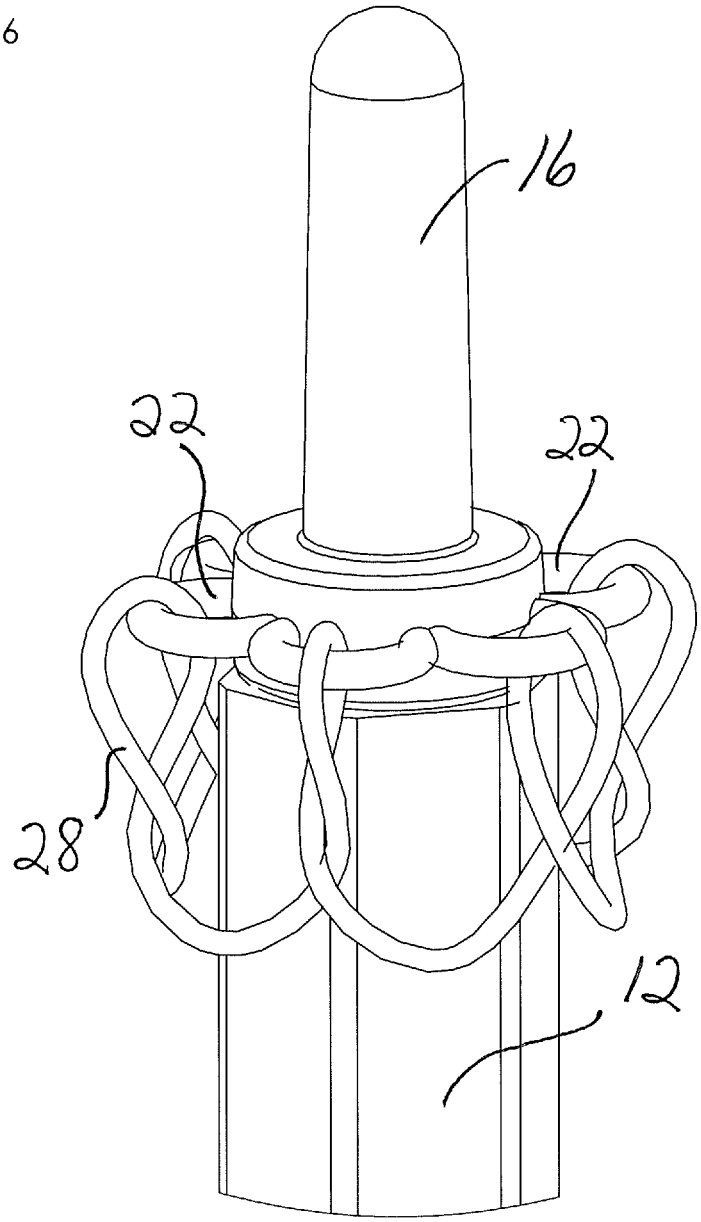
FIG. 7 is a side, perspective, detail view of the first row of wire loops depicted in FIG. 6.

FIG. 7 depicts a detail view of the first row of wire loops 28 depicted in FIG. 6.

Figure 8:
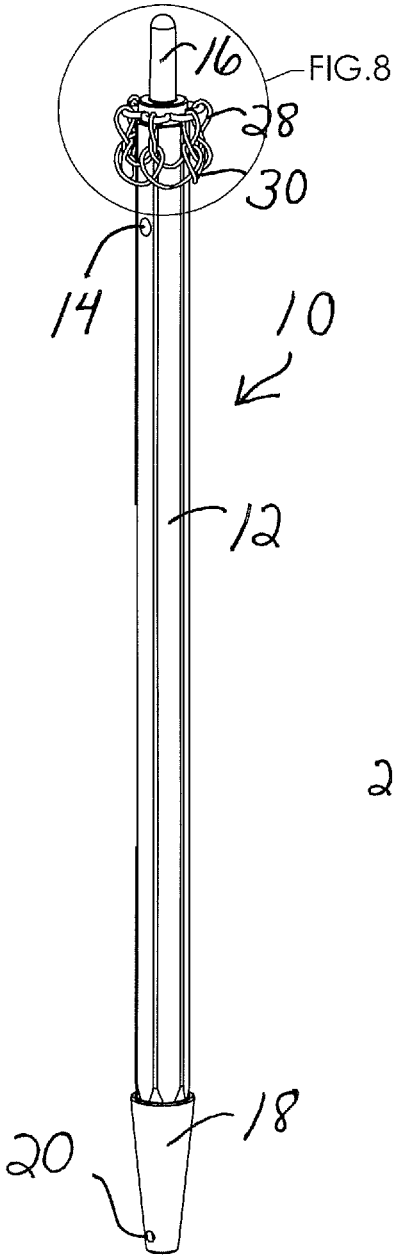
FIG. 8 is a side, perspective view of the embodiment depicted in FIG. 6, but with an additional second row stitch of Viking Knit hanging from the first row of wire loops.

FIG. 8 depicts a side, perspective view of the hand tool 10 depicted in FIG. 6, but with an additional second row stitch 30 of Viking Knit hanging from the first row of wire loops 28.

Figure 9:
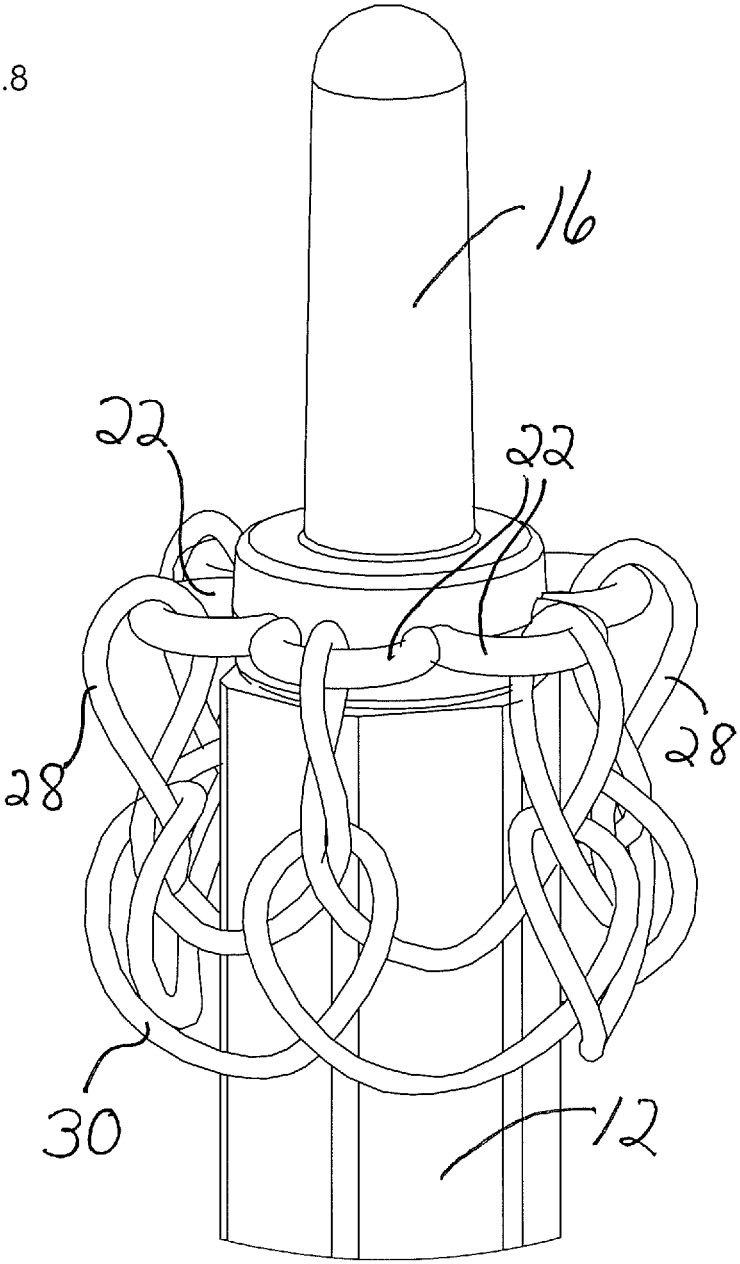
FIG. 9 is a side, perspective, detail view of the first row of wire loops and second row stitch of Viking Knit depicted in FIG. 8.

FIG. 9 depicts a detail view of the first row of wire loops 28 and additional second row stitch 30 of Viking Knit depicted in FIG. 8.

Figure 10:
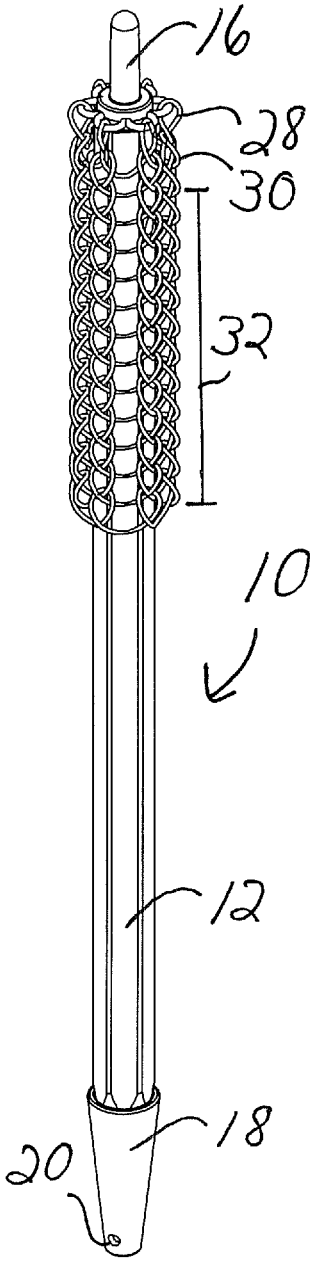
FIG. 10 is a side, perspective view of the embodiment depicted in FIG. 8, but with an additional third through twelfth rows of stitches of Viking Knit hanging from the first row of wire loops and second row stitch of Viking Knit.

FIG. 10 depicts a side, perspective view of the hand tool 10 depicted in FIG. 8, but with an additional third through twelfth rows of stitches 32 of Viking Knit hanging from the first row of wire loops 28 and second row stitch of Viking Knit 30. From FIG. 10, it is clear that the outer surface of the rod shapes the inside size and shape of the Viking Knit.

Figure 11:
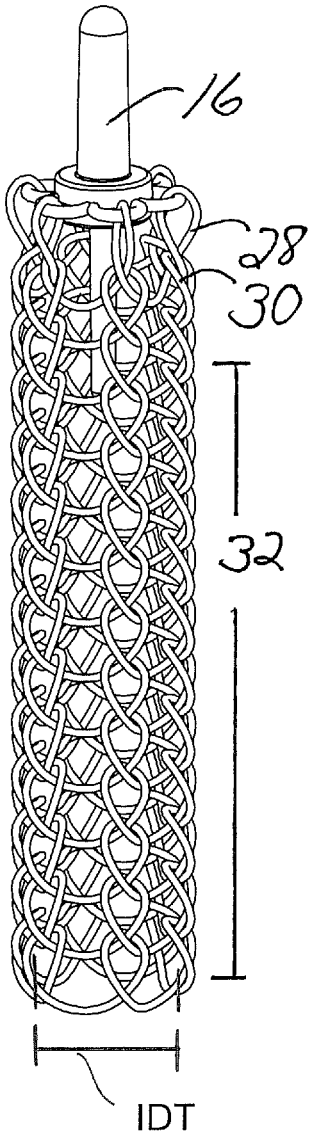
FIG. 11 is a perspective, detail view of the loop head, first row of wire loops and 12 rows of stitches of Viking Knit depicted in FIG. 10.

FIG. 11 depicts a perspective, detail view of the loop head 16, removed from the top of the rod as the weave is created and extended upwardly, first row of wire loops 28 and twelve rows of stitches 30 and 32 of Viking Knit depicted in FIG. 10. FIG. 11 also shows the inner diameter of the tube (IDT) made by the surface of the rod.

Figure 12:
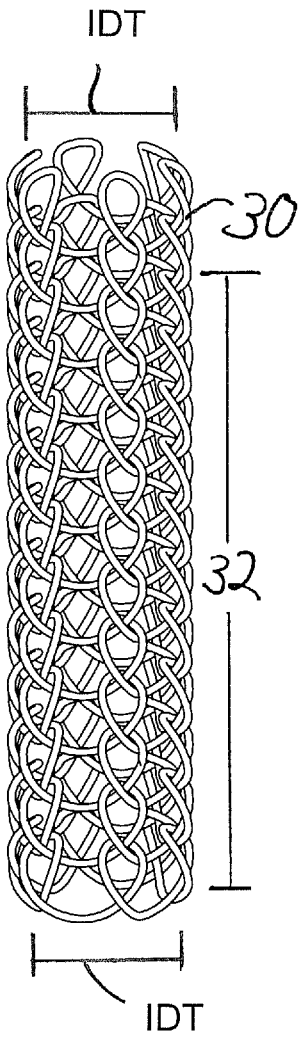
FIG. 12 is a perspective, detail view of the 12 rows of stitches of Viking Knit depicted in FIG. 10.

FIG. 12 depicts a perspective, detail view of the twelve rows of stitches 30 and 32 of Viking Knit depicted in FIG. 11, with the loop head removed from the weave by clipping the first row of wire loops. FIG. 12 also shows the inner diameter (IDT) of the woven wire tube.

Figure 13:
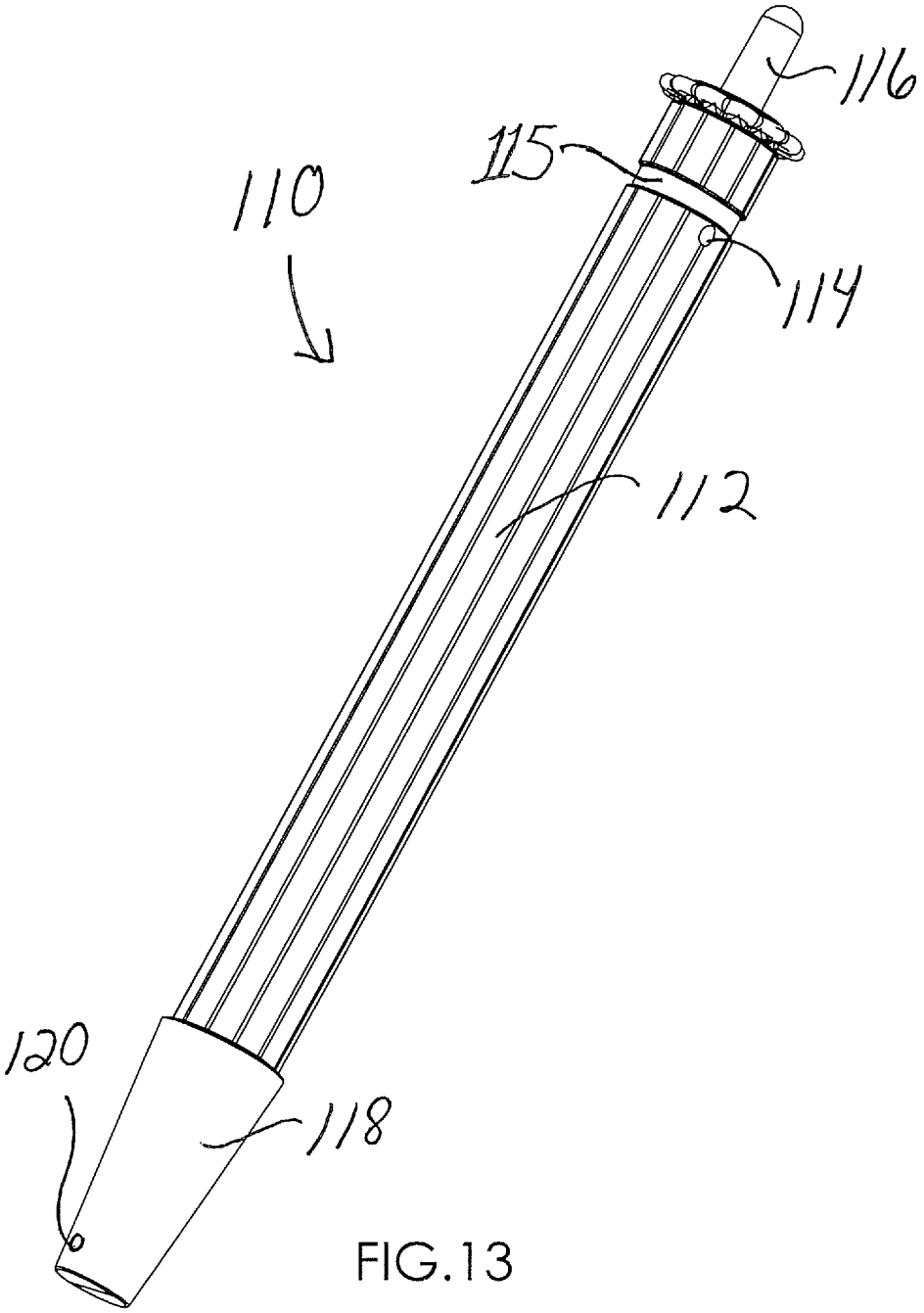
FIG. 13 is a side, perspective view of another embodiment of the present invention in a dodecagonal rod.

FIG. 13 depicts a side, perspective view of another, alternative embodiment 110 of the present Viking Knit hand tool in a dodecagonal rod 112. Rod 112 has an anchor hole 114 drilled into it near its top. Rod 112 has a twelve (12)-loop head 116 inserted into its top end, and a conical tip 118 formed at its bottom end. Tip 118 has hole 120 drilled through it generally perpendicular to the axis of rod 112. Recess 115 in the outer surface of the rod indicates for the length of the first row of the wire loops, and allows for additional room for the wire to slide under earlier stitches of wire and continuance of the weaving.

Figure 14:
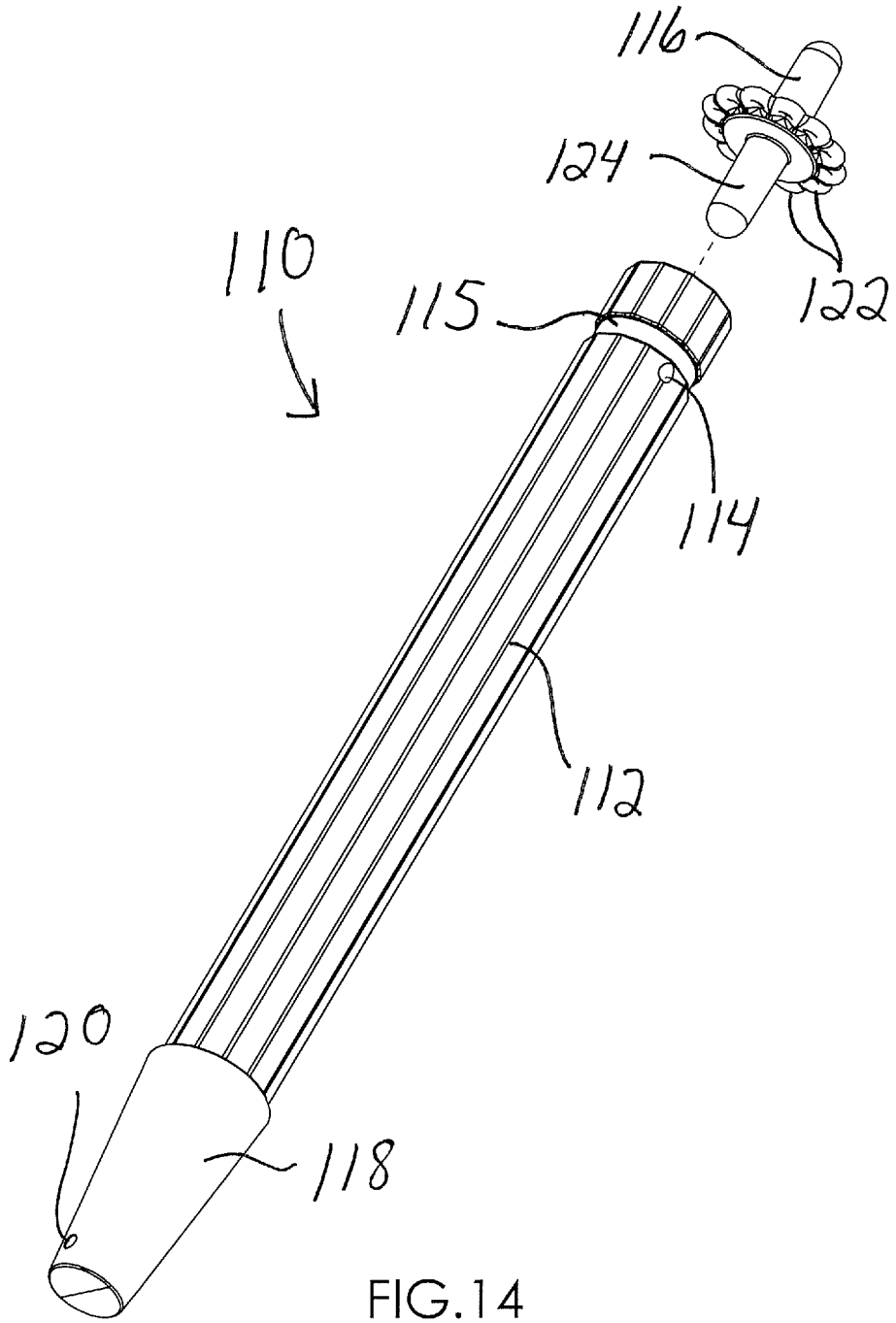
FIG. 14 is an exploded view of the embodiment depicted in FIG. 13.

FIG. 14 depicts an exploded view of the hand tool 110 depicted in FIG. 13. From FIG. 14 it is clear that loop head 16 has twelve (12) radially extending circumferential loops 122 and a central shaft 124 which fits into the top of rod 112.

Figure 15:
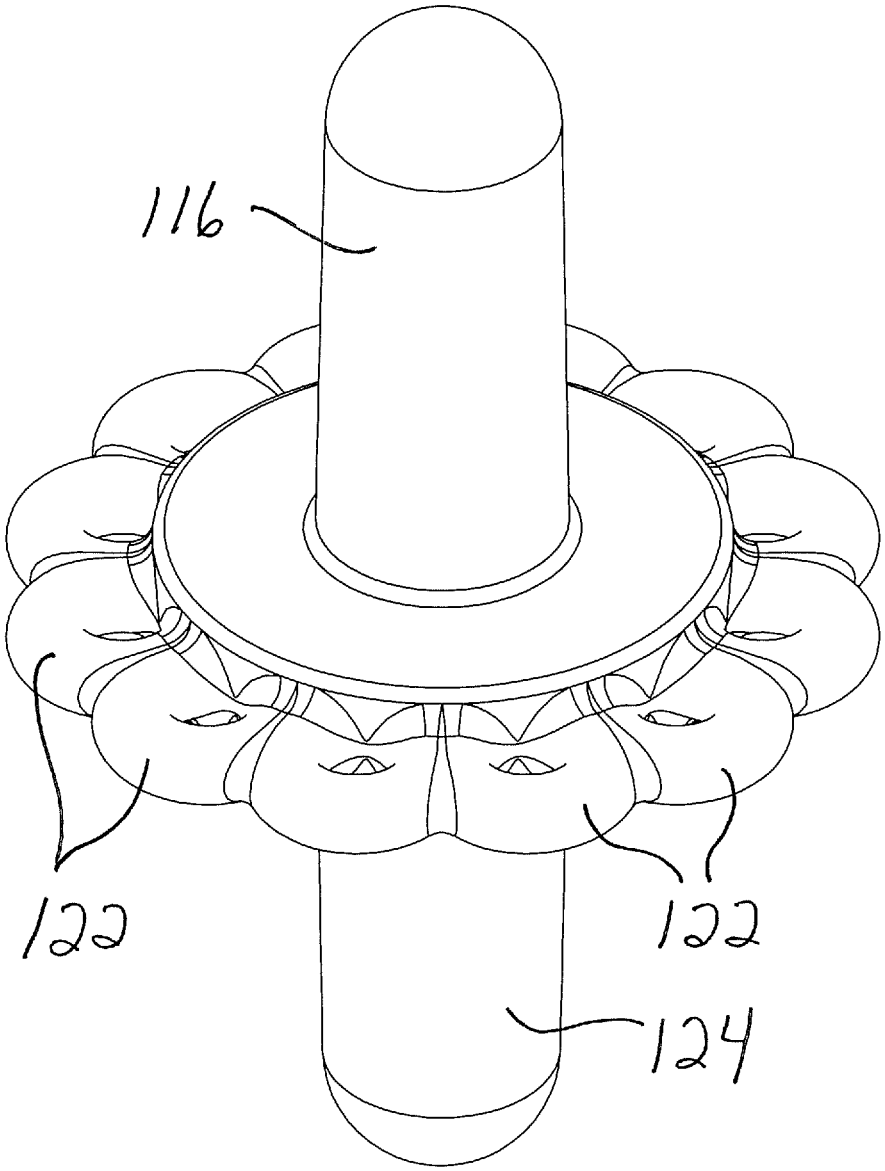
FIG. 15, is a side, perspective, detail view of the twelve (12)-loop head depicted at the top in FIG. 14.

FIG. 15 depicts a side, perspective, detail view of the twelve (12)-loop head 116 depicted at the top in FIG. 14.

Figure 16:
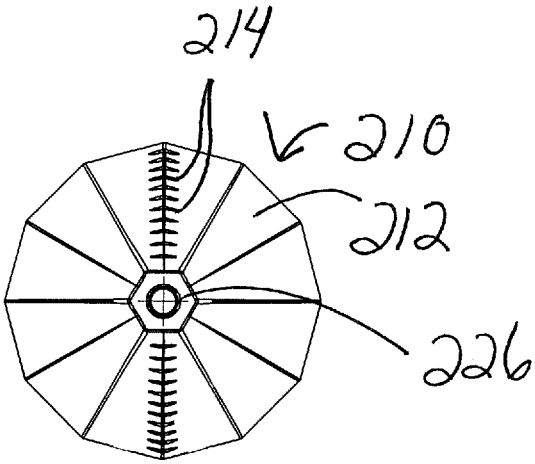
FIG. 16 is a top view of another embodiment of the present invention in a dodecagonal cone.

FIG. 16 depicts a top view of another, alternative embodiment 210 of the present Viking Knit hand tool in a dodecagonal cone 212. Cone 212 has a series of anchor holes 214 on two sides, and an opening 226 in its top end.

Figure 17:
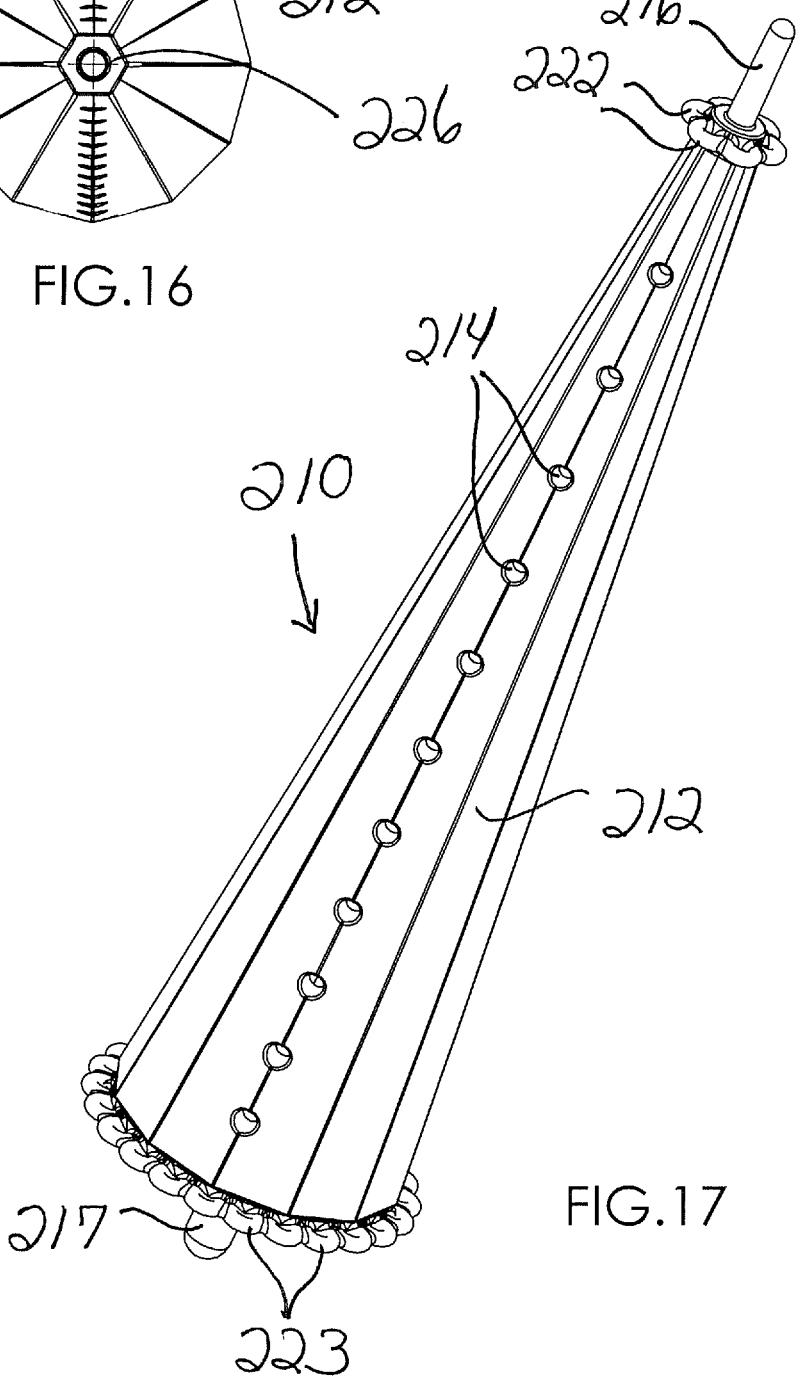
FIG. 17 is a side, perspective view of the embodiment depicted in FIG. 17, with a six (6)-loop head in the small end of the cone, and with a twenty-four (24)-loop head in the large end of the cone.

FIG. 17 depicts a side, perspective view of hand tool 210, with a six (6)-loop head 216 in the small end of the cone, and with a twenty-four (24)-loop head 217 in the large end of the cone. Head 216 has six (6) radially extending circumferential loops 222. Head 217 has twenty-four (24) radially extending circumferential loops 223.

Figure 18:
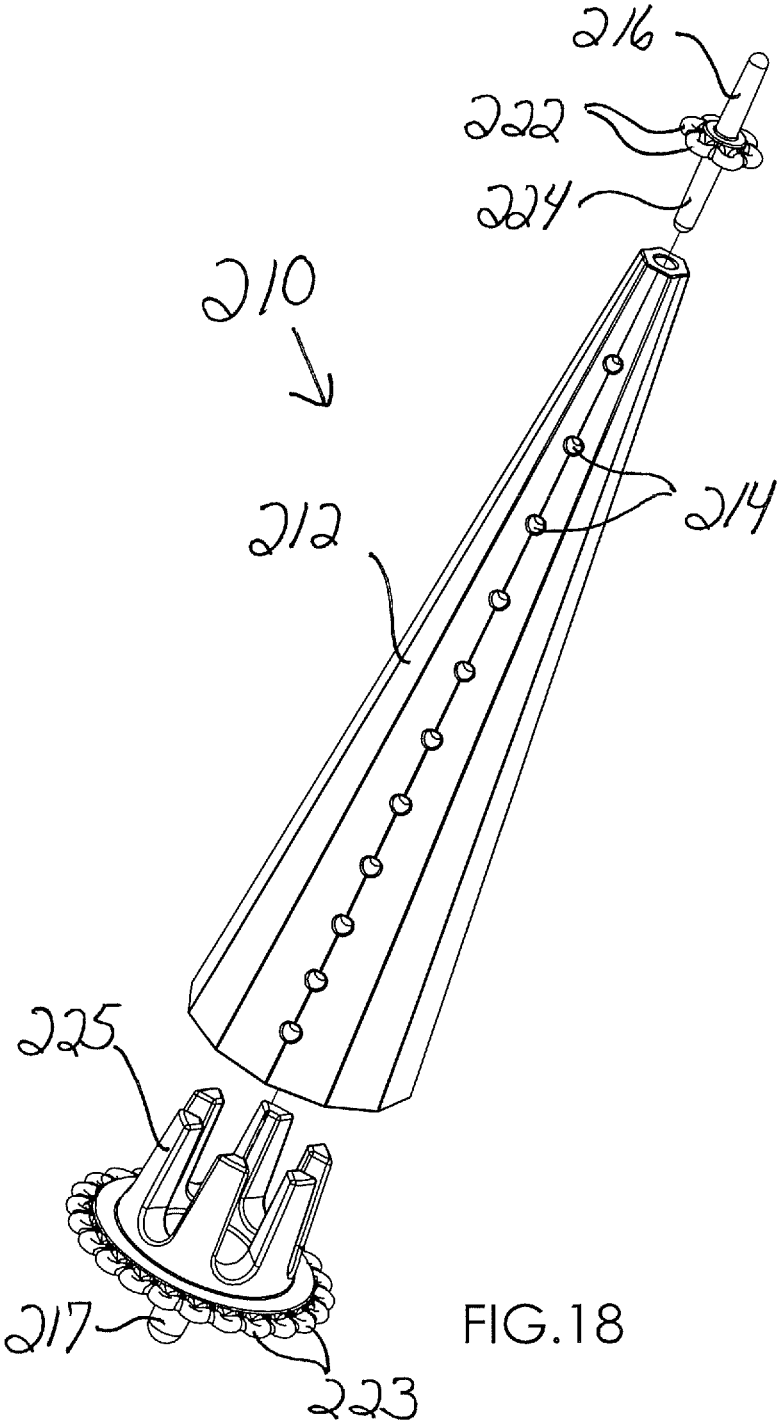
FIG. 18 is an exploded view of the embodiment depicted in FIG. 17.

FIG. 18 depicts an exploded view of the hand tool 210 depicted in FIG. 17. From FIG. 18 it is clear that head 216 with loops 222 has central shaft 224 which fits into hole 226 in the top of cone 212. Also from this FIG. 18 it is clear that head 217 with loops 223 has a plurality of interior legs 225 which collectively fit into a hole in the bottom of cone 212.

Figure 19:
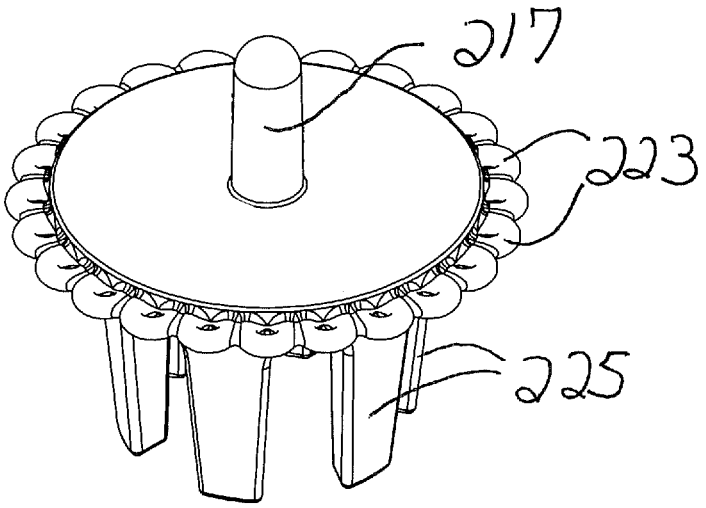
FIG. 19 is a bottom perspective, detail view of the twenty-four (24)-loop head depicted at the bottom in FIG. 18.

FIG. 19 depicts a bottom, perspective, detail view of the twenty-four (24)-loop head 217 depicted at the bottom of FIG. 18. Head 217 has twenty-four (24) radially extending circumferential loops 223, and several upwardly extending, spaced-apart legs 225 for fitting into the bottom of cone 212.

Figure 20:
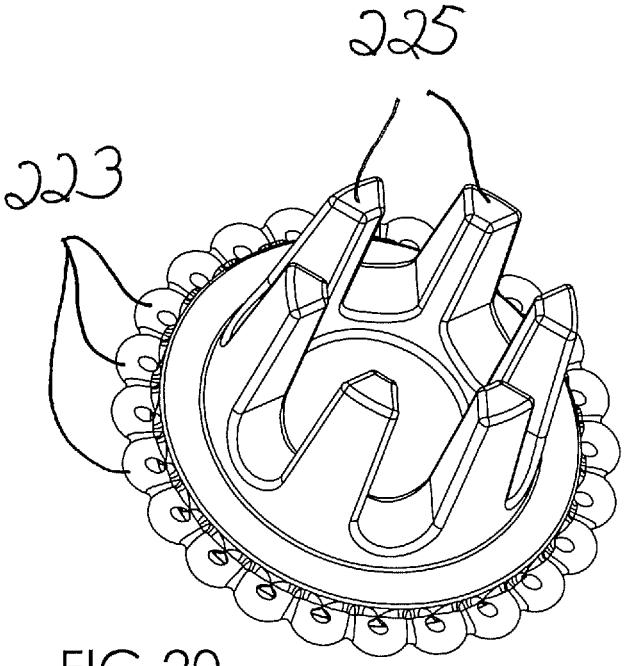
FIG. 20 is a top, perspective, detail view of the twenty-four (24)-loop head depicted in FIG. 19.

FIG. 20 depicts a top, perspective detail view of the twenty-four (24)-loop head 217 depicted at the bottom of FIG. 18. From FIG. 20 it is clear that head 217 has six (6) spaced-apart legs 225.

Figure 21:
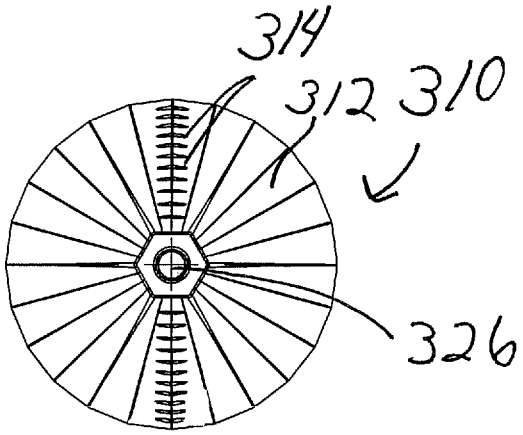
FIG. 21 is a top view of another embodiment of the present invention in a twenty-four (24)-sided cone.

FIG. 21 depicts a top view of another, alternative embodiment 310 of the present Viking Knit hand tool in a twenty-four (24)-sided cone 312. Cone 312 has a series of anchor holes 314 on two sides, and an opening 326 in its top end.

Figure 22:
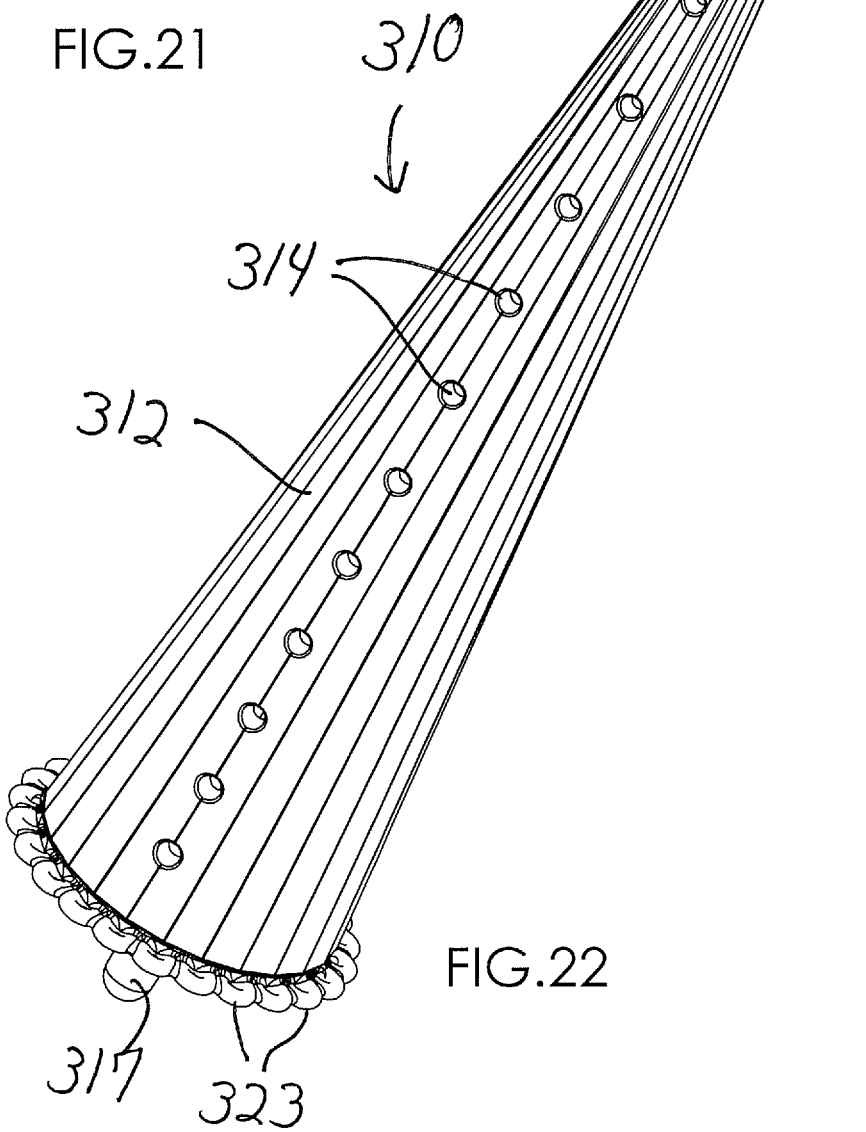
FIG. 22 is a side, perspective view of the embodiment depicted in FIG. 21, with a six (6)-loop head in the small end of the cone, and a twenty-four (24)-loop head in the large end of the cone.

FIG. 22 depicts a side, perspective view of hand tool 310, with a six (6)-loop head 316 in the small end of the cone, and with a twenty-four (24)-loop head 317 in the large end of the cone. Head 316 has six (6) radially extending circumferential loops 322. Head 317 has twenty-four (24) radially extending circumferential loops 223.

Figure 23:
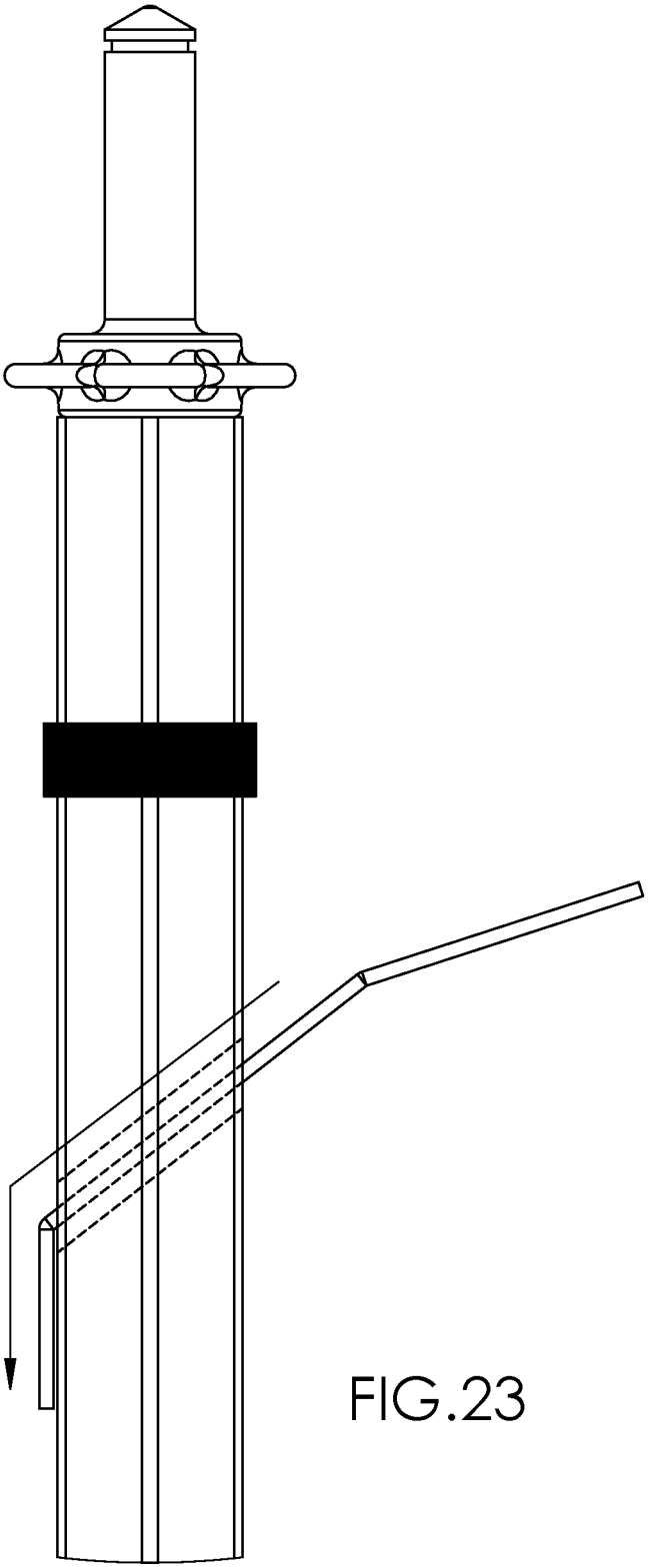
FIGS. 23 and 24 show certain steps of using an embodiment of the invention according to the description in the section below called "Detailed Use of A Preferred Tool".

Detailed Use of a Preferred Tool:

The preferred methods of using the tool may be understood by reference to the following steps:

With a black permanent marker, draw a line around the hex rod approximately ¼" from the top of the rod or apply the pin striping tape at the same height. Insert the loop head central shaft into the top hole. See FIG. 23.

Cut 30" of #26 gauge wire. Holding the rod in your left hand, insert one end of the wire into the top of the diagonal anchor hole, extending about 1 inch. Press the "anchor wire" down with your left forefinger to hold in place. See FIG. 23.

Row 1: Insert the remaining wire down through one of the head loops above the anchor hole. Gently pull the wire down then cross over the top of the previous wire to form an elongated loop. Use the black line as a guide to establish the length of the loop.

Use your left thumb to help hold the first loop in place. Bring the wire down through the next head loop on the right. Pull the wire down, taking care not to distort the first loop. Keep the wire on top and cross to the right.

Make 6 loops around. Keep the stitches similar in size and as evenly spaced as possible. Use the shape of the rod as a guide placing one loop on each side of the hex. This way, the outer surface of the rod determines the size and shape of the inside of the Viking Knit tube. The flat sides also allow extra space to get under the wire. Use the pin tool to help with spacing and to lift the wire if necessary.

The pin tool is sharp. Keep the plastic cover on the point when not in use. Keep away from animals and small children.

Row 2: Bring the wire, right to left, behind the first loop (on row one) at the bottom where the wires cross. Pull through then swing the wire back to the right to form a small loop. Working to the right, repeat on each loop around.

Row 3: Continue another round of loops. Use the first 3-6 rows (or more if necessary) to develop a consistent pattern.

The first few rows of Viking Knit can be cut away later, so don't worry if they aren't perfect. You will be amazed how much the draw plate helps to reposition and even out the stitches.

Row 4: Pull the beginning anchor wire out of the diagonal hole and cut close to work. Continue working around with the main wire.

As you continue to work, check to make sure you still have 6 loops on the rod.

Row 5 and beyond: continue working loops around.

Periodically slide the knit out the top of the rod every few rows, otherwise it may be hard to remove later. If it becomes stuck twist the knit tube around the rod to loosen.

Adding wire: move the last loop formed so that it is over the diagonal anchor hole at the top of the rod.

Cut another length of #26 wire, 24-30 inches, or whatever length you are most comfortable working with.

Figure 24:
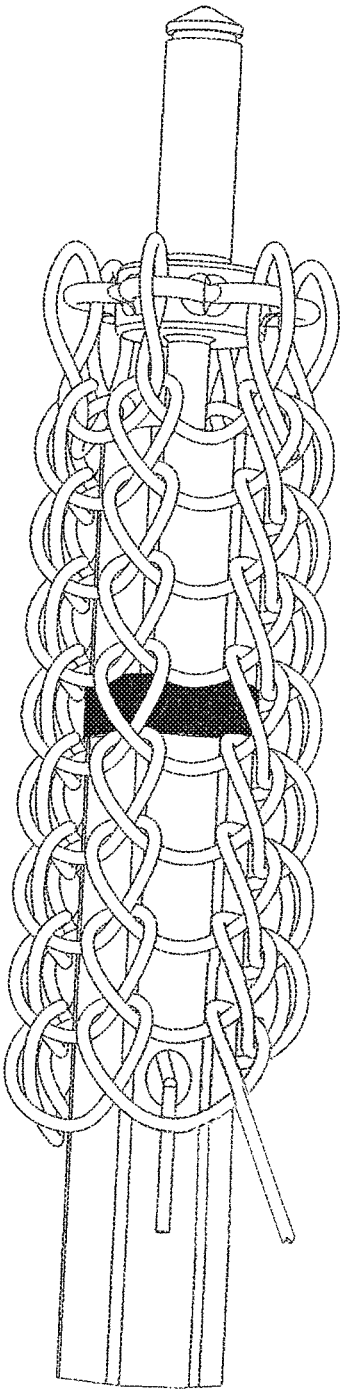

Insert one end of the wire through the last wire loop and into the diagonal hole, extending about 1 inch. Press the "anchor wire" down end with your forefinger to hold in place. Bring the free end of the wire under the next loop and continue. See FIG. 24. Work 3-4 rows then cut all wires except the main wire to continue working.

Determining length: The final length of your knit depends on how many loops you start with, how far down you draw the knit and the size wire you use.

As a general rule, if you start with 6 loops #26 gauge and make a 6-inch length of Viking Knit, you can gain 2-3 inches or more depending on how small you reduce the tube. The smaller the hole draw the longer the knit. The number of feet needed varies but about 15 feet of wire should be enough for a bracelet.

Preparing the knit: Remove the completed length of Viking Knit from the hex rod. Clip the top loops to remove the loop head and remove any loose wires.

Roll the knit between the soft side of the fabric cloth several times. This helps align the stitching and makes drawing easier.

Cut 3 pieces of #26 wire about 12 inches each. Insert the wires in through loops on rows 2 or 3. Fold wires together and twist. This will give you something to hold onto as you draw the knit through the draw plate. They will be removed later.

Draw plate: pull the knit through the largest hole several times. Continue to pull through each hole several times until the desired length and width is achieved.

You can cut the Viking Knit to any length—it will not unravel. Clip any sharp ends (where added wires began and ended) that may protrude.

About wire: many colored wires have a copper base with color coating on top. They are generally quite durable, however you can scratch the surface color off if not careful.

Different gauges of wire change the length and width of the knit: #24 and #28 gauge wires are suitable. #20 gauge is usually too hard to work.

To make a smaller diameter knit experiment by starting with 4 loops and #26 gauge or 5 loops with #28 gauge. This will allow you to pull the knit through the smallest hole on the draw plate. Just skip one or two loops on the loop head and space accordingly around the rod.

Making Coiled Wire End Caps

Use the Viking Knit hand tool described above to make two 3-4 inch lengths of coil.

Cut a 12" length of #20 gauge wire and insert one end into the small hole at the cone end of the hex rod.

Holding the rod with your right hand and the long wire in your left, turn the rod to wind the wire 3-4 times around the cone. Add the coil and continue to wind.

Cut the wire ½-inch at the bottom and make a small loop. Cut the top wire to release the coil. Finish by adding a loop at the top. The technique for making a Viking Knit with the cone tool is essentially the same as described above.

Advantages:

The Viking Knit Hand Tool eliminates the need for repeatedly creating a new start-up bundle for each project and instead uses a fitted, removable, free-turning, interchangeable loop head inserted into the top center of the rod according to the invention.

The hard plastic nylon rod material is more durable than a dowel or pencil. The vertical shape is preferable over a bent Allen wrench. Constant removal of the Viking Knit wire weave can wear down other, softer materials. The lightweight material is portable and does not necessitate the use of a stationary stand, such as a vise or clamp.

A diagonally drilled anchor hole makes startup, and the addition of new wire, easier by creating tension and a stationary direction for the new wire to be attached. In use, the last stitch of the Viking Knit is aligned over the top diagonal hole on the rod. The new wire is inserted through the existing knit stitch and down through the diagonal hole extending about 1". A forefinger is placed on the extended end to provide tension. The new wire is in position for the next stitch. After several rows of stitching the 1" extended end and the original wire are cut away leaving the new wire.

A starting line, indent in the outer surface of the rod, or loop length guide, is provided at the top of the rod, just below the wire loop attachment. The line aids in positioning the first row of Viking Knit.

The hex shape, plastic nylon rod reduces the need for an awl or other pointed instrument to lift the wire from the rod because the flat surfaces allow more clearance room for getting under the initial wire and adding new stitches. Lessening the use of an awl or other pointed instrument to move the wire also reduce the changes of accidentally scratching the surface of the wire, especially in the case of copper-based, color coated wires.

The six sides of the rod also compliment the 6-loop metal head insert. This collaboration is helpful in initially with forming and positioning the first rows of Viking Knit stitches. The rod is constructed of Quadrant Nylon Hexagon Bar, ¼" across flats (USP item #47521), measuring approximately 6 inches in length (vertical).

A vertical 1/16-inch hole, drilled in the top of the rod approximately ½" in depth is referred to as the central axial hole.

A ⅛-inch adhesive tape strip may be applied around the circumference of the rod approximately ¼'inch from the top of the rod, referred to as the "loop length guide". Alternatively, a black line can be drawn with a permanent marker.

In one embodiment, the "wire loop attachment" is comprised of one ⅛"×⅜" aluminum blind rivet and one 6-loop Bali silver bead cap, #C2010 0.45 grams, 4×10 mm made in Indonesia (beads-park.com). The bead cap is permanently adhered to the top of the rivet. The rivet and bead cap are then inserted into the central axial hole at the top of the rod.

A second 1/16-inch hole, drilled at a slight diagonal, starting approximately 1-inch from the top of the rod, allows the addition of start up or new wire. It is referred to as the "anchor hole".

A cone wire cap tool is permanently attached at the bottom of the rod. The cast metal cone is approximately ⅞-inch in length, part #BM60606-PE-003. A 1/16-inch hole is drilled through the metal cone near the smallest point. The hole is used to insert a base wire. Coiled wire, beads or other materials are added to the base wire. The base wire is then wrapped about the coil shape to form an end cap. Alternately, the hex rod itself may be shaped or sharpened at the bottom end to form a cone shape, eliminating the need for a metal cone. The cone wire cap tool is not essential to the creation of the Viking Knit weave; it offers a complimentary alternative finishing technique. However, the cone wire cap is also convenient for another important function associated with the Viking Knit Hand Tool. If the woven tube of wire becomes excessively tight on the rod or cone, the tube may be taken off, the rod or cone turned over and passed through the inside of the tube like a reamer. This way, due to the increased diameter of, for example, tip 18 (FIG. 1), or tip 118 (FIG. 14), the inner diameter of the woven tube will be increased, without the danger of scratching the wire, and the woven tube may be conveniently reinstalled on the rod or cone for additional weaving with a more relaxed fit.

One advantage of the Viking Knit Cone Tool is that, instead of limiting the traditional Viking Knit woven wire construction to a single, cylindrical shape, the cone form allows the woven knit to be formed into additional sizes and shapes, like open or closed cones, that add new dimension and opportunities for its use. The cone also eliminates the need to repeatedly create a new start-up bundle for each project and instead uses two or more fitted, removable, free-turning, interchangeable metal or plastic loop heads that can be inserted at either end of the cone. Heads can have a varying number of loops. The shape of the woven tube around the cone allows design options not available on the traditional straight rods.

The hollow cone has six flat sides at the smaller end (¼") converting to 12 or 24 flat sides at the larger end (1¼"). The overall length is 5". The six sides of the cone compliment a 6-loop plastic or metal head insert. A 12- or 24-loop metal or plastic head is used at the larger end. The flat surfaces are useful initially in and positioning the first rows of Viking Knit stitches: one or two stitches on each flat surface are useful for measuring stitch length, girth and shape.

The hollow cone is constructed of a plastic carbon and/or nylon reinforced material. Horizontal anchor hole sites of about 5/64 inch diameterare aligned at about ½ intervals down the length of the cone on one or both sides. The small end of the tool is a ¼" hexagon shape, graduating to 1¼" with 12 or 24 sides at the large end. Six-loop and a 24-loop head attachments are inserts at either ends of the cone.

Alternatives:

The hex tool may be modified in a number of respects, all without departing from the original intent and concept.

The diameter, length and hex shape could be changed to a larger or smaller diameter and the number of flat-sided surfaces could also be changed, for example, a ⅜" rod with four sides or a ½" rod with eight sides.

The rod material could be changed to wood, metal or other plastic materials. It can be solid or hollow. The rod may be round in diameter and not have flat sides at all. It could be attached to a stationary surface if necessary by means of a stand, vise or clamp.

The wire loop attachment can be shaped of a one-piece solid metal or plastic material with an increased or decreased number of loops forming the head. The size, depth and diameter of the rivet or pin inserted into the rod may vary in size.

Also, interchangeable wire loop attachments, of varying loop length and varying loop holes, could be used alternately with the same rod size or different rod sizes, depending on the style of Viking Knit mesh desired. Thus one could mix-and-match a five loop wire loop attachment with a five-sided ½" rod or a five-sided ¼" rod.

The number of wire loops on the wire loop attachment head need not correspond to the same number of flat sides on the rod. The flat sides of the rod help make the Viking Knit wrapping technique easier but can also aide in the placement of the Viking Knit loops.

The metal cone wire wrap accessory could be manufactured as part of the actual rod by sharpening the end of the rod into a graduated cone shape with an insert hole drilled at the end.

An alternative method for making the permanent or semi-permanent starting line at the top of the rod could be fashioned by the use of painted, a routed crevice or by burning or engraving a line onto the material.

The diagonal anchor hole could be located at varying heights and vary in diameter. Additional anchor holes could be added as starting points or to accommodate more than one wire.

The diameter of the rod, the number of starting loops, the size of wire used and the draw plate holes all contribute to determining various textures, diameters and sizes of a completed Viking Knit weave project.

The cone material could be changed to wood, metal or other plastic materials. It can be solid or hollow. The cone may be totally round in diameter and not have flat sides at all. It could be attached to a stationary surface if necessary by means of a stand, vise or clamp.

The plastic or metal loop attachments can be shaped of a one-piece solid metal or plastic material with an increased or decreased number of loops forming the head.

Interchangeable wire or plastic loop attachments, of varying loop lengths and varying loop holes, could be used alternately with the same cone size or different cone sizes, depending on the style of Viking Knit mesh desired.

The number of wire loops on the wire loop attachment head need not correspond to the same number of flat sides on the cone. The flat sides of the cone help make the Viking Knit wrapping technique easier but can also be used as a teaching aide to indicate the correct placement of the Viking Knit stitches.

Horizontal or vertical anchor holes could be located at varying heights and vary in diameter. Additional anchor holes could be added as starting points or to accommodate more than one wire.

The diameters of the cone, the number of starting loops at either end, the size of wire used and the draw plate holes all contribute to determining various textures, diameters and sizes of a completed Viking Knit weave project.

The end of the cone can be altered to include an end cap tool can be with the addition of an about 5/64 inch hole drilled through the cone about ¼" from the end. The hole is used to insert wire and wrap about the cone shape formed an end cap that may be used to complete a Viking Knit project.

Variations of this invention will occur to those skilled in the art. All such variations are intended to be within the scope and spirit of the Viking Knit Hand Tool, and not limited to those alternatives listed. A feature disclosed herein may be used together or in combination with any other feature on any embodiment of the tool. It is also contemplated that any feature may be specifically excluded from any embodiment of this tool.

Although this invention has been described above with reference to particular means, materials and embodiments, it is to be understood that the invention is not limited to these disclosed particulars, but extends instead to all equivalents within the scope of the following claims.

The invention claimed is:

1. A hand tool for weaving a woven tube, the woven tube having an inside diameter, the hand tool comprising:

an elongate surface adapted to be surrounded by the woven tube, the elongate surface for shaping the woven tube by contact with said woven tube inside diameter; and a body defined by the elongate surface, the body being adapted at one end to rotatably and axially slidably receive a head having a plurality of holes, the head being adapted to freely rotate relative to, and be freely substantially axially removed from, said one end of the body;

the holes being adapted to receive material for bending and weaving into the woven tube, so that, during weaving, the head freely rotates relative to the body, the head is freely substantially axially removable from the body, and the elongate surface continues to shape the woven tube;

wherein the head comprises a shaft that rotates in an axial hole in said one end of the body, and is axially-removable from said axial hole, and the head further comprises a plurality of loops each comprising one of said holes.

2. A hand tool as in claim 1, wherein the elongate surface is selected from the group consisting of: a cylindrical surface, a surface having multiple flat sides, a hexagonal surface, a dodecagonal surface, a conical surface, a twelve-sided conical surface, and a twenty-four sided conical surface.

3. A hand tool as in claim 1, further comprising a second head adapted to be positioned on a second end of the body that is opposite said one end of the body.

4. A hand tool as in claim 1, further comprising a diagonal anchor hole in the body near said one end of the body.

5. A hand tool as in claim 1, wherein the elongate surface is conical and has a length and the body comprises a series of anchor holes along the length of the elongate surface.

6. A hand tool for weaving a woven tube having an inside diameter, the hand tool having a longitudinal axis and a radial dimension and comprising:

an elongated body having a top end, a bottom end, and a length between the top end and bottom end, the elongated body comprising an outer, elongated surface for shaping the woven tube by contact with said woven tube inside diameter; and a top member freely rotatably connected to a top end of the body in a first position, and the top member being freely removable from the body to a second position where the top member is substantially axially distanced from the body;

wherein the top member comprises a plurality of holes radially distanced from the longitudinal axis and from the elongated surface of the body at the top end of the body, the plurality of holes being adapted to receive top portions of the woven tube, so that the top member freely rotates in said first position during weaving of initial rows of the woven tube, and when the top member is removed to the second position, the elongated surface continues to shape the woven tube;

wherein the top member comprises a shaft that rotates in an axial hole in the top end of the body and is axially-removable from said axial hole, and the top member further comprises a plurality of loops each having one of said holes.

7. A hand tool as in claim 6, wherein the body outer elongated surface is selected from a group consisting of: a cylindrical surface, a surface having multiple flat sides, a hexagonal surface, a dodecagonal surface, a conical surface, a twelve-sided conical surface, and a twenty-four sided conical surface.

8. A hand tool as in claim 6, further comprising a diagonal anchor hole in the body near the top end of the body.

9. A hand tool as in claim 6, wherein the body outer elongated surface is conical and the body further comprises a series of anchor holes along the length of the conical outer elongated surface.

10. A hand tool as in claim 6, wherein said outer elongated surface is conical and comprises multiple flat sides and multiple anchor holes along the length of the conical outer elongated surface, wherein the hand tool further comprises a bottom member connected to the bottom end of the body and comprising a plurality of loops extending radially and circumferentially outward from the bottom member.

11. A weaving system for making a woven tube, the system comprising:

a woven tube having a head-end, an opposite end, and an inside diameter; and a hand tool comprising:

a body having a first end, a second end, a longitudinal axis between said first end and said second end, and an outer, elongated surface extending between said first and second ends and surrounded by the woven tube, the elongated surface shaping the woven tube by contact with said woven tube inside diameter; and a tool head having a longitudinal axis and a radial dimension, the tool head comprising a plurality of holes radially distanced from the tool head longitudinal axis and receiving portions of the head-end of the woven tube to secure said head-end to the tool head; and the tool head being being rotatably and removably connected to said body, so that the tool head, in a first position, is connected to the body and freely rotates relative to the body while the woven tube is first woven along elongated surface of the body; and the tool head, in a second position, is removed from the body and substantially axially distanced from the body, and the head-end of the woven tube remains secured to the tool head by said portions of the head-end of the woven tube being received in the holes, while said opposite end of the woven tube continues to be woven along, and shaped by, the elongated surface of the body;

wherein the tool head comprises a shaft that rotates in an axial hole in the first end of the body and is axially-removable from said axial hole, and the tool head further comprises a plurality of loops each having one of said holes.

12. A system as in claim 11, wherein the holes are radially distanced from the elongated surface of the body when the tool head is in the first position.

13. A system as in claim 11, wherein the outer, elongated surface is selected from the group consisting of: a cylindrical surface, a surface having multiple flat sides, a hexagonal surface, a dodecagonal surface, a conical surface, a twelve-sided conical surface, and a twenty-four sided conical surface.

14. A system as in claim 11, further comprising a diagonal anchor hole in the body near the first end of the body.

15. A system as in claim 11, wherein said body is conical and comprises multiple flat sides and multiple anchor holes along the length of the conical body, wherein the hand tool further comprises a second tool head at the second end of the body and that comprises a plurality of loops extending radially and circumferentially outward from second tool head.

* * * * *